United States Patent [19]

Hori

[11] 3,947,137

[45] Mar. 30, 1976

[54] SOCKET FOR A BALL POINT PEN

[75] Inventor: Jiro Hori, Kure, Japan

[73] Assignee: The Sailor Pen Co., Ltd., Tokyo, Japan

[22] Filed: Sept. 16, 1974

[21] Appl. No.: 506,341

[30] Foreign Application Priority Data

Dec. 18, 1973 Japan ..... 48-145685[U]

[52] U.S. Cl. ..... 401/217; 401/212

[51] Int. Cl. ..... B43k 7/02

[58] Field of Search ..... 401/216, 217, 109, 226, 401/44, 132–135, 212–215, 209–211

[56] References Cited

UNITED STATES PATENTS

| | | | |
|---|---|---|---|
| 2,847,975 | 8/1958 | Lawton | 401/217 |
| 3,063,420 | 11/1962 | Tefft | 401/209 |
| 3,537,801 | 11/1970 | Cortt | 401/217 |

FOREIGN PATENTS OR APPLICATIONS

| | | | |
|---|---|---|---|
| 513,008 | 8/1928 | Germany | 401/212 |
| 435,349 | 3/1948 | Italy | 401/217 |
| 692,212 | 6/1953 | United Kingdom | 401/217 |

*Primary Examiner*—Lawrence Charles
*Attorney, Agent, or Firm*—Flynn & Frishauf

[57] ABSTRACT

A socket for a ball point pen comprises a hollow sleeve receiving a writing ball at the forward end, a rod member forcefully inserted into the sleeve to be pressed at the forward end against the writing ball, and ink passageways defined between the sleeve and rod member so as to extend throughout the socket. The sleeve is provided with a communication section for causing the ink passageways to communicate with the outside of the socket, thereby attaining a reliable delivery of ink from the ink passageways to the writing ball and preventing ink from leaking out of the pen body through an air passage provided at the forward end portion of the barrel of the ball point pen.

6 Claims, 6 Drawing Figures

SOCKET FOR A BALL POINT PEN

BACKGROUND OF THE INVENTION

1. Field of the Invention

This invention relates to a socket for a ball point pen suitable for use with low viscosity aqueous ink, and more particularly to a socket for a ball point pen which is designed to deliver a proper amount of ink quickly from an ink cartridge to a writing ball when the cartridge is inserted into the ball point pen.

2. Description of the Prior Art

Most of the prior art ball point pens using aqueous ink have the ink reservoir in the barrel filled with aqueous ink. When therefore, a long period of time passes before the ball point pen is actually used after being manufactured, the ink held in the ink passageways provided in the socket to connect the writing ball with the cartridge often becomes so dry as to flow with great difficulty or not at all when the user is going to commence writing, rendering the ball point pen utterly unavailable for practical application. To eliminate the above-mentioned difficulties accompanying most of the ball point pens using aqueous ink, there has been developed such type of ball point pen as is designed to be fitted in use with a cartridge filled with aqueous ink. With a known ball point pen, however, the ink passageways provided in the socket are so narrow that under natural conditions, the ink held in the cartridge is delivered only by capillary action to the writing ball through the passageways. Therefore, the aforesaid developed type of ball point pen has the drawback that ink takes too long to reach the writing ball after the cartridge is inserted into the pen body, preventing the pen from being immediately put to use. For quick ink delivery, the user often manually squeezes the ink-filled cartridge fitted into the socket after removing the pen body in order to apply pressure on the ink held in the cartridge. With a general ball point pen, however, a clearance between the writing ball and the edge of the tip portion of the socket is smaller than in the ordinary ball point pen using viscous ink, preventing the air remaining in the ink passageways from easily escaping out of the ball point pen through the forward end of the socket. As a result, the air itself exerts a resistive force within the ink passageways, not only obstructing the quick influx of fresh ink thereinto, but also preventing the ink already held in the passageways from being delivered to any proper outlet due to the prevalence of the air resistance. Accordingly, the ink is unavoidably forced out of the pen body through an air duct provided at the forward end of the pen barrel, undesirably wetting the forward end.

SUMMARY OF THE INVENTION

It is accordingly an object of this invention to provide a socket for a ball point pen, the sleeve of which is provided inside with ink passageways and a communication section causing the ink passageways to communicate with the atmosphere, thereby enabling aqueous ink to be supplied to a writing ball smoothly and quickly from the very start of writing.

Another object of the invention is to provide a socket for a ball point pen which prevents aqueous ink from soiling a barrel by being forced out therefrom through an air duct even when an ink cartridge mounted in the socket is manually squeezed to apply pressure to the ink to enable the ink to quickly flow from the cartridge.

According to this invention, a socket for a ball point pen comprises a hollow sleeve for receiving a writing ball at the forward end; a rod member inserted into the sleeve in a fluid tight state so as to abut against the writing ball at the forward end; ink passageways defined between the sleeve and rod and open to both ends of the sleeve; and a communication section provided in the sleeve to cause the ink passageways to communicate with the atmosphere.

The communication section plays the part of conducting the air remaining in the ink passageways to the atmosphere as aqueous ink is successively brought into the passageways, thereby enabling a proper amount of aqueous ink to be quickly delivered to the writing ball through the passageways and also preventing the ink from leaking through the air duct to soil the forward end of the barrel of the ball point pen as often occurs when it is attempted quickly to force the ink into the passageways from the ink cartridge connected to the socket by manually squeezing the cartridge.

BRIEF DESCRIPTION OF THE DRAWING

This invention will be described by way of example with reference to the accompanying drawings.

DESCRIPTION OF THE PREFERRED EMBODIMENTS

Throughout the drawings, the similar parts are denoted by the same numerals.

Figure 1:
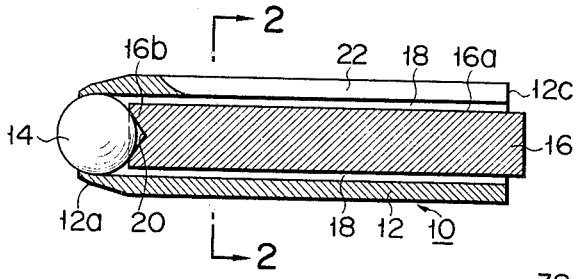
FIG. 1 is a longitudinal sectional view of an embodiment of a socket for a ball point pen according to this invention.
Figure 2:
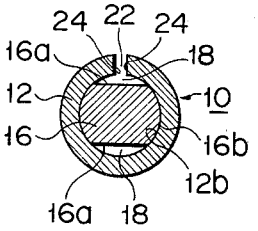
FIG. 2 is a cross sectional view on line 2—2 of FIG. 1.

Referring to FIGS. 1 and 2, a socket 10 has a hollow cylindrical sleeve 12. As seen from FIG. 1, the sleeve 12 receives a writing ball 14 in the forward end portion 12*a*, which in turn is crimped or deformed to prevent the ball 14 from falling out.

As is apparent from FIG. 2, a rod member 16 having a flat plane 16*a* formed at two opposite peripheral portions and presenting a drum shape in cross section as a whole is inserted into the sleeve 12 in close contact (FIG. 2) with the inner wall 12*b* thereof, except for the flat planes 16*a*.

The flat planes 16*a* of the rod member 16 and the inner wall 12*b* of the sleeve 12 define two ink passageways or ink conducting chambers 18.

The rod member 16 is formed of wear-resistant and corrosion-resistant material, such as nylon impregnated with molybdenum disulfide ($MoS_2$), carbon fiber-reinforced plastic (CFRP) or bearing metal material. A funnel-shaped seat 20 (FIG. 1) is provided at the forward end 16*b* of the inserted rod 16 to receive the writing ball 14, thereby fixing its position in the axial direction of the socket 10.

The sleeve 12 has part of its peripheral wall bored with a slit-like communication section or chamber 22 lengthwise extending from the rear end 12*c* of the sleeve 12 to the proximity of the forward end 12*a* thereof. In other words, that portion of the sleeve 12 which extends from the proximity of the forward end 12*a* to the rear end 12*c* has a C-shaped cross section as shown in FIG. 2. The communication chamber 22 is defined by a pair of spatially facing parallel wall surfaces 24 of the sleeve 12. The communication chamber 22 is open to the rear end 12*c* of the sleeve 12 so as to be easily machined.

Figure 3:
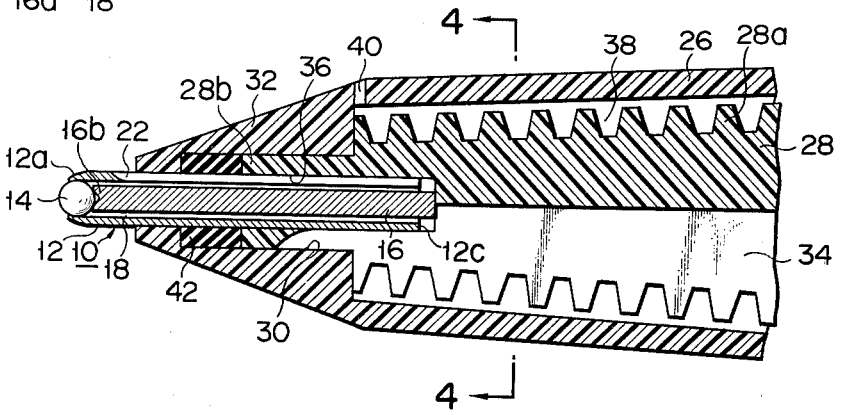
FIG. 3 is a longitudinal sectional view of the tip portion of a ball point pen with the socket of FIG. 1 inserted therein.

FIG. 3 illustrates the forward end portion of the barrel 26 of a ball point pen using the socket 10. The barrel 26 receives a feed bar 28 having its peripheral wall provided with a plurality of annular projections 28*a*. The smaller diameter cylindrical forward end portion 28*b* of the feed bar 28 is inserted in a fluid tight state into a cylindrical hole 30 bored in the tip portion 32 of the barrel 26.

Figure 4:
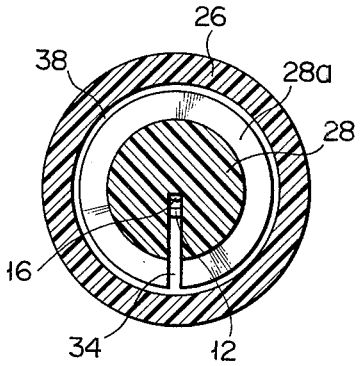
FIG. 4 is a cross sectional view on line 4—4 of FIG. 3.

The feed bar 28 is provided with a narrow ink groove 34 (see FIG. 4) whose deepest part reaches the central line of the feed bar 28 and which extends all along the feed bar 28 except for the forward end portion 28*b*. A long cylindrical hole 36 penetrates the forward end portion 28*b* and part of the main body of the feed bar 28 in such a manner that the hole 36 is concentric with the forward end portion 28*b* of the feed bar 28. The socket 10 is inserted into the long cylindrical hole 36 so as to cause that portion of the communication chamber 22 which is disposed near the forward end 12*a* of the sleeve 12 to be exposed out of the tip portion 32 of the barrel 26. In the rear end of the feed bar 28 is mounted a cartridge (not shown) filled with aqueous ink, which is conducted through the groove 34 to the passageways 18. An air duct 40 is provided in the forward portion of the barrel 26 so as to cause a control chamber 38 defined by the inner wall of the barrel 26 and the peripheral wall or annular projections 28*a* of the feed bar 28 to communicate with the atmosphere. The control chamber 38 normally contains both aqueous ink and air.

When there is a change in the temperature within the barrel 26 or in the pressure applied to the ink passing through the groove 34, the air duct 40 plays the part of allowing air to be brought into the control chamber 38 from the atmosphere or conversely to be discharged from the control chamber 38 into the atmosphere, thereby fixing the pressure applied to the aqueous ink flowing through the groove 34 and consequently enabling the ink to be supplied to the passageways 18 of the socket 10 smoothly at a constant rate. A ring member 42 is placed in the hole 30 of the tip portion 32 of the barrel 26 and disposed ahead of the forward end portion 28*b* of the feed bar 28. The ring member 42 tightly holds the peripheral wall of the socket 10 inserted therein to prevent the socket 10 from readily falling out of the tip portion 32 of the barrel 26. Further, the ring member 42 prevents ink from running over the outer peripheral wall of the socket 10 to leak from the engagement section between the socket 10 and tip portion 32.

There will now be described the operation of a ball point pen using the socket of this invention. When a cartridge filled with aqueous ink is mounted in the rear end of the feed bar 28, the ink passes by capillary action through the groove 34 into the passageways 18 at the rear end of the socket 10. The air which is filled in the passageways 18 before the arrival of the ink is expelled to the atmosphere through the communication chamber 22 due to the influx of the ink. Accordingly, the ink brought into the passageways 18 displaces the air contained therein and is quickly and smoothly conducted to the writing ball 14. The cartridge is sometimes manually squeezed, for example with one's fingers, to attain the quick delivery of ink to the writing ball 14 from the cartridge soon after it is fitted to the feed bar 28. In this case, the air remaining in the passageways 18 immediately escapes into the atmosphere through the communication chamber 22 as the ink rapidly comes into the passageways 18 due to the pressures applied to the ink. Accordingly, the ink quickly reaches the writing ball 14 with little air resistance, substantially eliminating the possibility of the ink overflowing from the groove 34 and leaking to the atmosphere from the air duct 40 due to the overburdened capacity of the control chamber 38 and in consequence soiling the outer surface of the barrel 26.

In contrast, the prior art socket for a ball point pen lacks a portion corresponding to the communication chamber 22 used in the socket of this invention. Therefore, the air remaining in the passageways has to be discharged into the atmosphere through a narrow clearance between the sleeve and writing ball in order to be displaced by the ink brought into the passageways, naturally causing the ink not only to take too long to reach the writing ball but also to run over the ink groove due to the prevalence in the passageways when the ink cartridge is manually squeezed for quick delivery of ink therefrom, as is sometimes attempted. In such case, the overflowing ink runs out of the pen through the control chamber and air duct to soil the pen barrel.

It is seen from the foregoing description that a socket according to this invention for a ball point pen eliminates the drawbacks accompanying the prior art socket.

Figure 5:
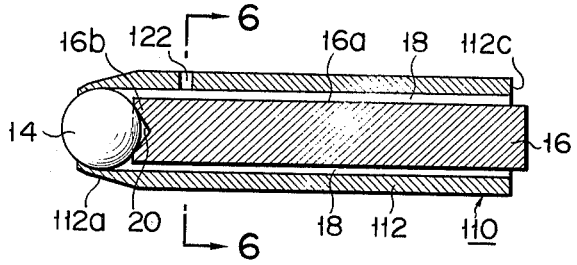
FIG. 5 is a longitudinal sectional view of a socket according to another embodiment of the invention for a ball point pen.
Figure 6:
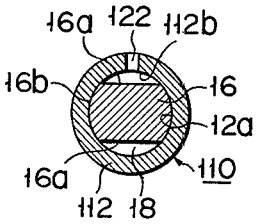
FIG. 6 is a cross sectional view on line 6—6 of FIG. 5.

FIGS. 5 and 6 jointly illustrate a socket according to another embodiment of this invention for a ball point pen. The difference between the preceding embodiment of FIGS. 1 to 4 and that of FIGS. 5 and 6 is that in the second embodiment, the slit-like connection chamber 22 is replaced by a hole-shaped communication chamber 122 which is provided in a hollow cylindrical sleeve 112 near its forward end portion 112*a* to establish communication between the ink passageways 18 and the atmosphere. This chamber 122 which corresponds to the communication chamber 22 of the preceding embodiment formed in the socket 10 penetrates the sleeve 112 in the radial direction to attain communication between the ink passageways 18 and the atmosphere.

Throughout FIGS. 5 and 6, numerals 110, 112*b*, 112*c* respectively denote the socket, and the inner wall and rear end of the sleeve 112. The other numerals show the same parts as those of the preceding embodiment of FIGS. 1 to 4.

When the socket 110 is inserted into the tip portion 32 of the barrel 26, the communication chamber 122 is brought outside of the tip portion 32, causing the ink passageways of air conducting chambers 18 to communicate with the atmosphere through the communication chamber 122. The socket 110 of the second embodiment shown in FIGS. 5 and 6 is operated with the same effect as the socket 10 of the first embodiment of FIGS. 1 to 4, description thereof being omitted by way of eliminating duplication.

What is claimed is:

1. In a socket for use with a ball point pen comprising a barrel, a feed bar disposed in the barrel coaxially therewith, and an air duct formed in the barrel for communication between the atmosphere and a control chamber defined between the barrel and the feed bar, the improvement wherein said socket comprises:

a. a hollow sleeve firmly held in the tip portion of the barrel as well as in the forward end portion of the feed bar;

b. a writing ball located in the forward end portion of the sleeve, said forward end portion of the sleeve being crimped to hold said writing ball;

c. a rod member inserted into the sleeve with the forward end thereof pressed against the writing ball, said rod member having at least one flat plane on the outer periphery thereof;

d. at least one ink conducting chamber defined between the inner wall of the sleeve and the at least one flat plane; and e. a communication chamber formed in the sleeve for direct communication between the ink conducting chamber and the atmosphere, at least part of said communication chamber being exposed to the atmosphere so as to expel air filled in the conducting chamber directly to the atmosphere due to ink being being brought into the conducting chamber.

2. A socket according to claim 1, wherein the communication section comprises a slit-like communication chamber extending lengthwise of the sleeve.

3. A socket according to claim 2, wherein the communication chamber extends from the proximity of the forward end to the rear end of said sleeve.

4. A socket according to claim 1, wherein the communication section comprises a hole-shaped communication chamber provided in the sleeve near its forward end.

5. A socket according to claim 1 wherein said rod member has a second flat plane on the outer periphery thereof.

6. A socket according to claim 5 wherein said flat planes of said rod member are opposite each other.

* * * * *